US009887469B1

(12) United States Patent
King, Jr. et al.

(10) Patent No.: US 9,887,469 B1
(45) Date of Patent: Feb. 6, 2018

(54) INSULATION DISPLACEMENT WIRE CONNECTOR WITH AN EXTERIOR WIRE GUIDE

(71) Applicants: L. Herbert King, Jr., Chesterfield, MO (US); James Keeven, O'Fallon, MO (US); William Hiner, O'Fallon, MO (US)

(72) Inventors: L. Herbert King, Jr., Chesterfield, MO (US); James Keeven, O'Fallon, MO (US); William Hiner, O'Fallon, MO (US)

(73) Assignee: THE PATENT STORE LLC, O'Fallon, MO (US)

( * ) Notice: Subject to any disclaimer, the term of this patent is extended or adjusted under 35 U.S.C. 154(b) by 0 days.

(21) Appl. No.: 15/330,340

(22) Filed: Sep. 8, 2016

(51) Int. Cl.
*H01R 4/24* (2006.01)

(52) U.S. Cl.
CPC ..... *H01R 4/2454* (2013.01)

(58) Field of Classification Search
CPC ... H01R 4/2454; H01R 4/2433; H01R 13/501
USPC ..... 439/399, 387, 397, 404, 417
See application file for complete search history.

(56) References Cited

U.S. PATENT DOCUMENTS

| | | | | |
|---|---|---|---|---|
| 4,932,873 | A * | 6/1990 | La Shier | H01R 12/675 29/842 |
| 5,690,505 | A * | 11/1997 | Hirata | H01R 4/2433 439/402 |
| 7,581,964 | B2 * | 9/2009 | Fujimaki | H01R 13/6658 439/76.1 |
| 7,934,941 | B2 * | 5/2011 | Hayauchi | H01R 4/2433 439/417 |
| 8,215,980 | B1 * | 7/2012 | Lin | H01R 4/2433 439/404 |
| 2006/0223360 | A1 * | 10/2006 | Chiba | H01R 12/675 439/404 |
| 2010/0167579 | A1 * | 7/2010 | Hayauchi | H01R 4/2433 439/426 |

* cited by examiner

*Primary Examiner* — Vanessa Girardi
(74) *Attorney, Agent, or Firm* — Jacobson & Johnson LLC

(57) ABSTRACT

A wire connector for connecting and maintaining a branch wire connected to a main uncut wire during handling of the wire connector and without cutting the main wire by laterally inserting the main uncut wire into a laterally open wire port in a piston sleeve and extending a cut end of a branch wire through an offset wire guide on the exterior of the wire connector and then reversing the branch wire direction to form a slack loop in the branch wire before inserting the end of the branch wire into a further wire port in the piston sleeve.

21 Claims, 3 Drawing Sheets

INSULATION DISPLACEMENT WIRE CONNECTOR WITH AN EXTERIOR WIRE GUIDE

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

In some field applications branch connections need to be formed to a main electrical line without disrupting or severing the main electrical line. This is particularly true with tracer wires as one oftentimes needs to attach a branch wire to a main wire to form an electrical connection therebetween without cutting the main wire. One of the difficulties in forming a mechanical wire connection between a main tracer wire and a branch tracer wire is that one needs to maintain the integrity of the wire connection during the subsequent handling of the wire connector. The handling of the wire connector prior to or during the burial of the branch wire may accidently pull the branch wire free from the main wire, which results in an open circuit. One of the types of connectors commonly used to form such mechanical electrical connections between insulation covered tracer wires and the like are insulation displacement connectors since they can simultaneously form an electrical connection between wires even though the insulation is not stripped from the wires.

The insulation displacement connectors, which are well known in the art, typically comprise a pair of cantilevered spaced apart blade members each having internal edges for penetrating through an outer insulation cover on a wire to bring the edges into electrical contact with the electrical wire. The insulation displacement connectors, which are often referred to as IDC connectors allow one to quickly form an electrical connection between insulation covered electrical wire and the blade members within the IDC connector without having to manually remove the insulation covering from the wire. The spacing of the blunt edges of the blade from each other are sized so that when an electrical wire with an insulation covering is forced between the blunt edges on the blades the blunt edges penetrate through the softer insulation covering to bring the blunt edge of the blades into electrical contact with the harder metal electrical wire. Typically, the spacing between the blades is wider at the top to facilitate insertion of the wire between the blades.

Examples of insulation displacement connectors can be found in the following U.S. patents.

U.S. Pat. No. 4,682,835, shows an IDC connector where the thickness of upper part of the blade is at a reduced dimensions compared to the lower section of the blade.

U.S. Pat. No. 4,826,449 shows a pair of blades that includes projections on the back edge of the blades to stiffen the blades and increase resistance to outward deformation of the blades during wire insertion at low temperatures.

U.S. Pat. No. 4,002,391 shows an IDC connector with a set of offset swages in the blades to cut the insulation from different sides as the wire is inserted between the blades.

U.S. Pat. No. 3,636,500 shows an IDC connector with that cut a square notch in the insulation through sharp corner edges on the blades that remain in place until engaged by the conducting wire.

U.S. Pat. No. 3,521,221 shows tapered edges on the blade so more than one size electrical wire can be inserted into electrical engagement with the blades.

U.S. Pat. No. 7,934,941 shows an IDC connector, which has a pair of covers that are folded together to clamp the electrical wire therebetween.

U.S. Pat. No. 7,458,840 shows a set of parallel blades that are connected together with different slot spacing between each of the blades. In one pair of blades there is a narrow slot located at the slot entrance of one pair of blades and a wide slot located at the bottom of the blades at the other pair of blades there is a wide slot located at the slot entrance and a narrow slot at the bottom of the slot.

U.S. publication 2016/0218444 shows an insulation displacement connector with dual blades for engaging the wires therein.

U.S. publication 2015/0288078 shows another example insulation displacement connector with levers for bringing the blades in the wire connector into engagement with the wires therein.

The examples of IDC connectors listed above reveal that a variety of insulation displacement connectors are available that allow one to form an electrical connection through an insulation covered wire without having to strip the insulation covering from the wire. Typically, one of the advantages of IDC connectors is that they can be used to connect a main wire line to a branch wire line without having to cut the main wire line, which makes them useful in applications such as tracer wire applications where a series of branch wire lines may be connected to a main wire line in order to provide an underground wire network that can later be located using above ground equipment. Typically, the tracer wires are placed along an underground pipeline when the pipeline is buried so that one can later detect the location of the underground pipeline with above ground equipment through the sensing the presence of the underground tracer wires. In most cases the main underground pipeline includes branch underground pipelines, which also need to be identified through placement of tracer wires along the branch lines. To identify both the main pipeline and the branch pipeline a branch tracer wire, which extends along a branch pipeline is connected to the main tracer wire that extends along the main pipeline, preferably without severing the tracer wire that extends along the main pipeline. The simultaneous formation of the electrical connection and the removal of the insulation on the branch line wire and the main line wire, which occurs in one step is a time saving field benefit. However, unless care is taken in handling the IDC connector the electrical connection formed therein may be disrupted during the subsequent handling of the IDC connector thus spoiling the electrical connection between the branch wire and the main wire. This is particularly true in cases where the IDC connector joining the main wire and the branch wire are buried underground since the forces generated on the wires during the process of burying the connector in the soil may unknowingly disrupt the electrical connection between the branch wire and the main wire. If the broken electrical connection is noticed, one must remove the connector from the soil and reform the electrical connection therein and then rebury the connector in the soil. On the other hand, if the broken electrical wire connection is not noticed a future operator may not be able to detect or locate the underground branch pipeline, which may lead to disastrous results since an operator digging in the area may accidently rupture the branch pipeline, for example with a backhoe shovel or the like, which can cause an explosion or at the least cause an environmental disastrous as the contents of the branch pipeline are released into the environment.

SUMMARY OF THE INVENTION

A wire connector for connecting and maintaining a branch wire connected to a main uncut wire during handling of the wire connector and without cutting the main wire by laterally inserting the main uncut wire into a laterally open wire port in a piston sleeve and extending a cut end of a branch wire through an offset wire guide on the exterior of the wire connector and then reversing the branch wire direction to form a slack loop in the branch wire as the direction of the branch wire is reversed before inserting the end of the branch wire into a further wire port in the piston sleeve with the piston sleeve carrying a slideable piston having a set of insulation displacement blades that remove insulation from both the branch wire and the main wire while forming an electrical connection therebetween. The piston, which is isolated on one side of a lid, may be forced into the piston sleeve, either through hand pressure or use of pliers since a compression surface on the lid and a compression surface on the piston are in axial alignment with each other. Once the connection of the main wire to the branch wire has been formed the piston and piston sleeve with the wire connection therein can be quickly encapsulated in a sealant by pivoting the lid with the insulation displacement connector into a sealant-containing chamber of a housing through a living hinge that connects the housing to the lid. The lid may then be secured to the housing through a set of latches. While the main line, which is uncut, exits laterally from the housing the branch line connected thereto also exits laterally and follows a circuitous path to form a slack loop therein as the branch wire loops back on itself through the tubular guide, which is located on the outside of the housing. The introduction of a slack loop on the outside of the wire connector increases the resistance to accidental disruption of the connection of the branch line to the main line during the handling of the wire connector since the branch wire outside the connector is now capable of movement with respect to the wire connector without disrupting the wire connections therein.

DESCRIPTION OF THE PREFERRED EMBODIMENT

Figure 1:
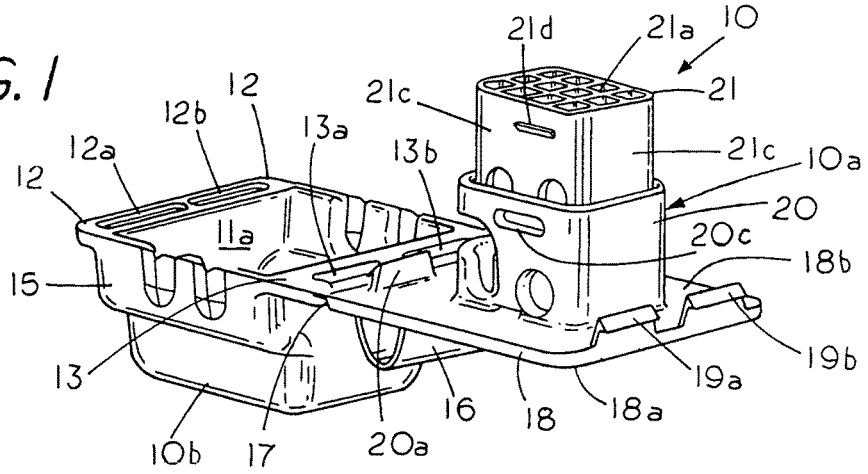
FIG. 1 is a perspective open view of a wire connector with a lid mounted insulation displacement connector for attachment of a branch wire to a main wire without having to cut the main wire.

FIG. 1 is a perspective open view of a wire connector 10 comprising a lid mounted insulation displacement connector 10*a* for use in on-the-go attachment of a branch electrical wire to a main electrical wire without having to cut the main wire to form the electrical junction therebetween. The wire connector 10 includes a living hinge 17 connecting a lid 18, which carries the insulation displacement connector 10*a*, to a housing 10*b* having a chamber 11*a* therein for encapsulating the lid mounted insulation displacement connector 10*a*. Located at one end of housing 10*b* is a planar lip 12 and on other end is a planar lip 13 with lip 12 including a first slot or lip latch 12*a* and a second slot or lip latch 12*b* with the lip latches located in a side-by-side position. On the other end of housing 10*b* planar lip 13 includes a first slot or lip latch 13*a* and a second slot or lip latch 13*b*, which are also located in a side-by-side position. The lid 18, which connects to lip 13 through a living hinge 17, includes an offset tubular wire guide 16 that extends across the outside surface 18*a* of lid 18. In this example the interior circumferential surfaces of lid 18 can be mated to the lips 12 and 13 on of the housing 10*b* through pivoting the lid 18 about the living hinge 17. Once pivoted the lid 18 can then be latched to the housing 10*b* to thereby protect the insulation displacement connector 10*a* from the environment.

Figure 2:
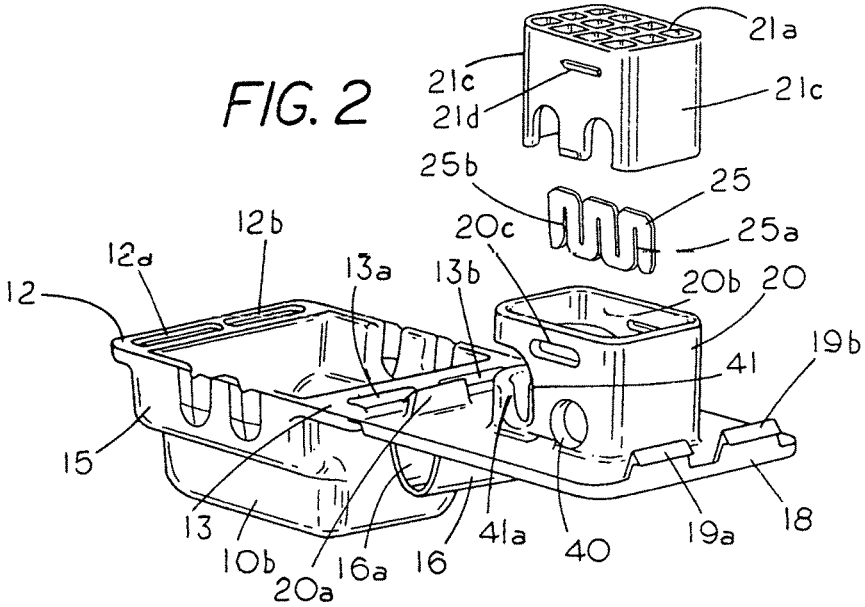
FIG. 2 is an exploded view of the lid mounted insulation displacement connector of FIG. 1.
Figure 3:
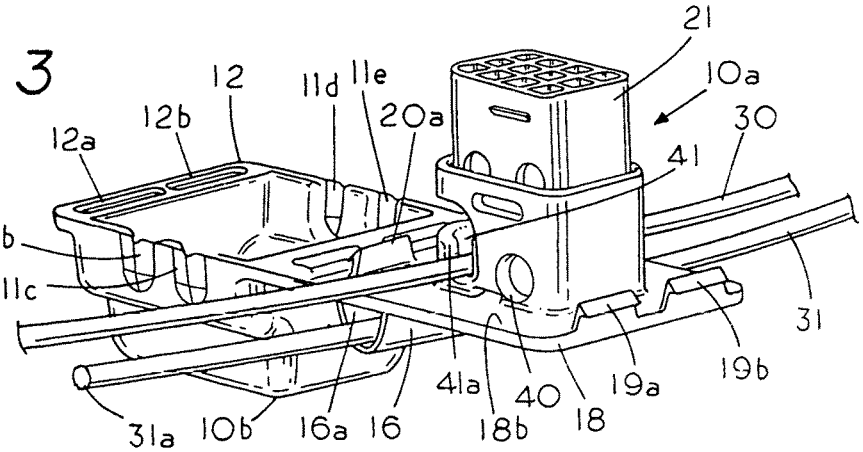
FIG. 3 shows the lid mounted insulation displacement connector of FIG. 1 with an uncut main wire and a branch wire threaded through a wire guide on the lid.

Mounted on the inside 18*b* of lid 18 is the insulation displaced connector 10*a* that includes a piston sleeve 20 with a slideable piston 21 therein. In this example the piston 21 has a top surface 21 and sidewalls 21*c* that slidingly fit within mating internal sidewalls 20*b* of piston sleeve 20 to allow the piston 21 to slide downward within piston sleeve 20 when axial pressure is applied to piston top surface 21*a* and to outside surface 18*a* of lid 18. Once the piston is depressed to form an electrical connection therein a protrusion 21*d* on piston 21 locks with the edge of slot 20*c* in piston sleeve 20 to hold the insulation displacement connector 10*a* in a closed or locked condition to ensure that the blades within the connector remain in contact with the wires therein. FIGS. 1-3 show that one end of lid 18 includes a first latch hook 19*a* for engagement with lip latch 12*a* and a second latch hook 19*b* for engagement with lip latch 12*b*. The other end of lid 18 includes a third latch hook 20*a* for engagement with lip latch 13*a* and a fourth latch hook 20*b* (see FIG. 8) for engagement with the lip latch 13*b*. Located on the exterior surface of lid 18 is a tubular wire guide 16 that extends crosswise across the lid 18 and is laterally offset from a wire port 40 in piston sleeve 21.

FIG. 2 is an exploded view of the lid mounted insulation displacement connector 10*a* of FIG. 1 showing the axially slideable piston 21 that carries a metal insulation displacement blade 25 that can form an electrical connection as the insulation is removed from a wire. As blade 25 is activated by forcing piston 21 downward a first wire enters the slot 25*a* and a second wire second wire enters the slot 25*b*. The displacement of the wires into the slots causes the edges of the blade 25 proximate the slot to remove the insulation from the wires and at the same time form an electrical connection between the wires through the electrical conducting blade 25. Examples of such blades can be found in applicants pending application U.S. publication 2016/0218444, which is hereby incorporated by reference.

FIG. 3 shows the lid mounted insulation displacement connector 10*a*, which is centrally located as well as centrally isolated on an inside surface 18*b* of lid 18. An uncut main insulation covered electrical wire 30 is shown located in a laterally open wire port 41 that is laterally open at the top to allow insertion of an uncut wire therein but includes a lower lip 41*a* to laterally retain wire 30 therein until the electrical connection is formed therein.

FIG. 3 also shows a branch insulation covered electrical wire 31 with a cut end 31*a* with the branch wire 31 extending through an opening 16*a* in a tubular wire guide 16, which is integrally formed on the exterior of lid 18. As can be seen the uncut main wire 30 has been laterally inserted into lateral wire port 41 and into a position where electrical contact can be made through engagement with blade 25 while the branch wire 31 remains separate from the insulation displacement connector 10*a*.

Figure 3A:
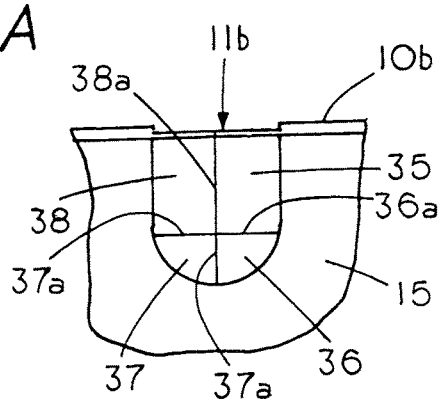
FIG. 3A shows an isolated view of a set of flexible flaps on the wire connector housing that allow lateral insertion of a wire therein.
Figure 8:
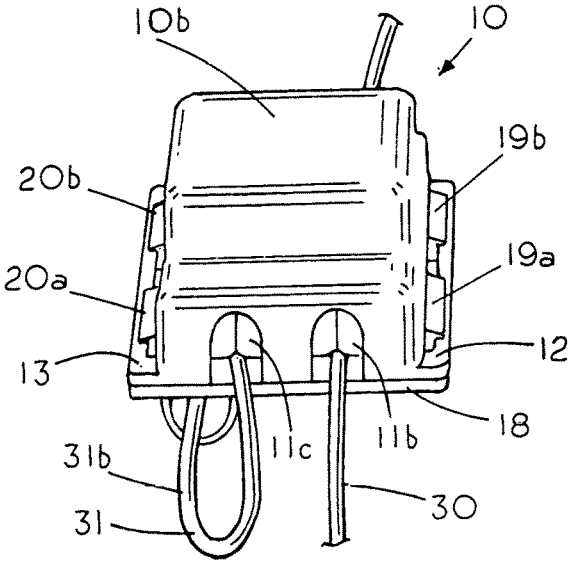
FIG. 8 is a perspective view of outside of the wire connector in a closed condition.

FIG. 3 shows a set of flap members 11*b*, 11*c*, 11*d* and 11*e*, which comprise a set of laterally enterable flexible wire ports, that allow the branch wire and the main wire to extend through the circumferential sidewall 15 of the housing 10*b* when the lid 18 carrying the insulation displacement connector 10*a* is folded onto housing 10*b*. FIG. 3A shows an isolated detail of housing 10*b* revealing that cantilever flap member 11*b* includes a set of cantileverly mounted flaps 35, 36, 37 and 38 that form a laterally enterable wire entry port 11*b* in housing 10*b*, which allows wires carried by the insulation displacement connector 10*a* to extend through the sidewall 15 of the housing 10*b* when the lid 18 is brought into engagement with the housing 10*b*. The outermost edges of cantilever mounted flaps 35, 36, 37 and 38 form a living hinge with the housing 10*b* while the inner edges 36*a*, 37*a* and 38*a* indicate separation edges where each of the cantilevered flaps can flex apart or separate as one inserts a wire between the flaps 35, 36, 37 and 38. While only one of the sets of flap members 11*b* is described herein the flap members 11*c*, 11*d* and 11*e* are identical. The sealing action of the flap members 11*b* and 11*c* is illustrated in FIG. 8, which shows wire 30 extending through flat 11*b* and wire 31 extending through flap 11*c*. Although not shown the flaps 11*d* and 11*e* operate in an identical manner in relation to sealing around the wires extending outward from the opposite side of the insulation displacement connector 10*a*.

Figure 4:
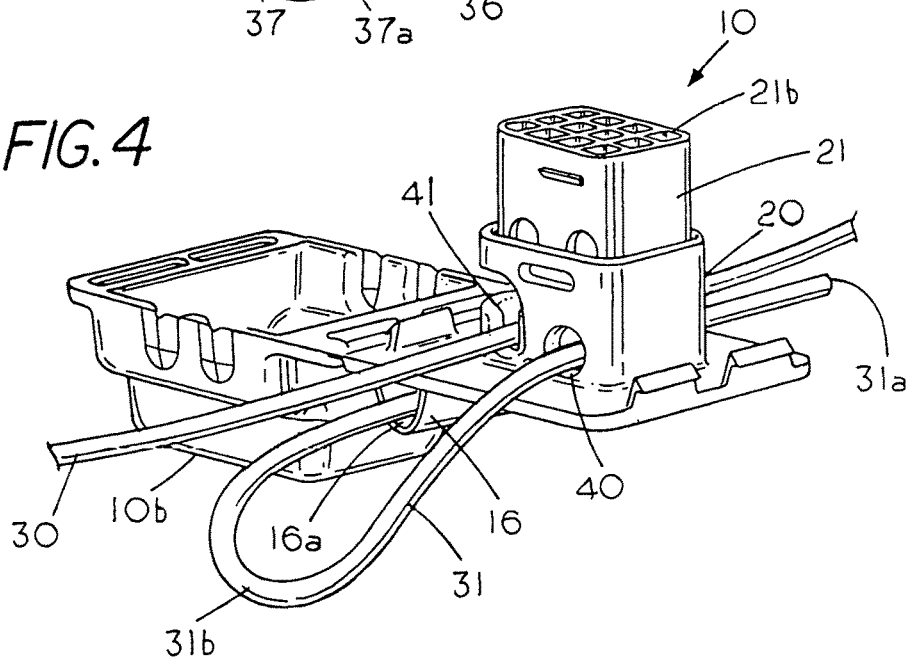
FIG. 4 shows the lid-mounted insulation displacement of connector of FIG. 3 supporting the uncut main wire and the branch wire with the branch wire having a slack looped formed by looping the branch wire into the lid mounted insulation displacement connector.

FIG. 4 shows the lid-mounted insulation displacement connector 10*a* of FIG. 3 with the uncut main wire 30 in lateral wire port 41. In order to generate slack loop 31*b* the wire branch wire 31 extends through tubular guide 16 and is looped backward 180 degrees until it extends through the wire port 40. The tubular guide 16 allows one to form a slack loop 31*b* in branch wire 31 that can accommodate accidental wire displacement without disrupting the electrical connection in the wire connector. FIG. 3 and FIG. 4 show piston 21 in the up position, which enables an operator to insert end 31*a* of branch wire 31 into port 40 and to laterally place main wire 30 in wire port 41. A feature of the invention is that the main wire 30 remains in an uncut condition while the branch wire 31 has been cut with a cut end 31*a* extended through an opening 16*a* in tubular guide 16, which is laterally offset from the wire port 40. In addition, in this example the opening 16*a* in tubular guide 16 is larger than the wire 31 so that an operator can use the inherent stiffness of wire 31 to thread the wire 31 through the tubular guide 16 thus avoiding the need for a wire-pulling device. Even though the tubular wire guide 16 has a larger diameter than the branch wire 31 the tubular wire guide maintains the slack loop 31*b* in wire 31 even though the size of the slack loop 31*b* may change in response to burial of the wire connector.

Figure 5:
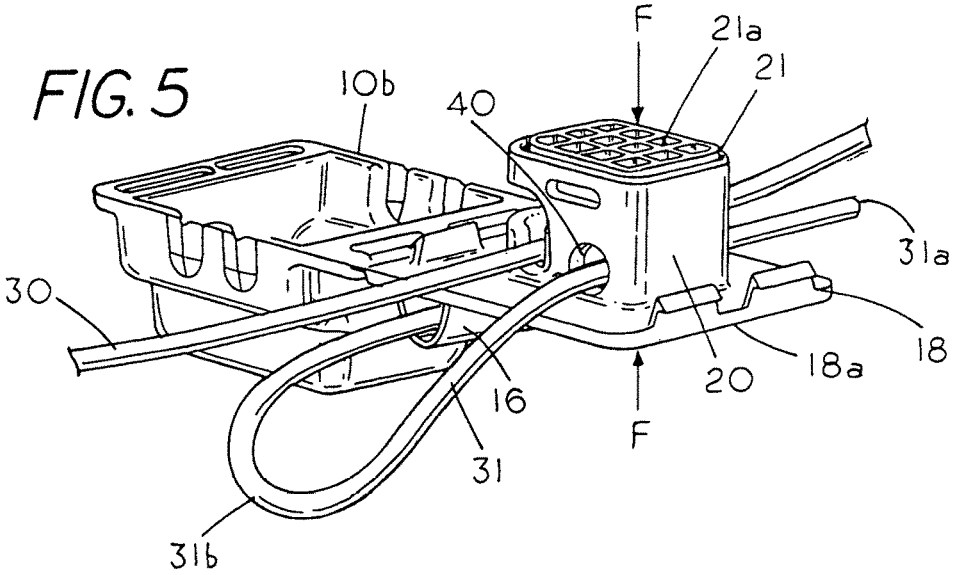
FIG. 5 shows the lid mounted insulation displacement connector of FIG. 4 in the wire engaging position with the branch wire having a slack looped formed by looping the branch wire into the lid mounted insulation displacement connector.

FIG. 5 shows that the piston 21 carrying the insulation displacement blades 25 (FIG. 2) has been forced into the piston sleeve 20 through the application of a force F on the lid outer surface 18*a* and the piston top surface 21*a*. A feature of the invention is that the placement of the insulation displacement connector 10*a* on the lid 18 is such that an axial compression force F can be conviently applied to lid surface 18*a* and the piston top surface 21*a* to bring the piston 21 into the piston sleeve 20. Methods of applying force may be through jaws of a plier or the like since the tubular guide 16 is laterally offset from a compression axis of the insulation displacement connector 10*a* and thus does not interfere with exerting compression forces directly on the insulation displacement connector and the lid supporting the insulation displacement connector 10. In this example the slack loop 31*b* is located on the outside of the housing so the branch wire 30 extends through the flap members in the housing.

Figure 6:
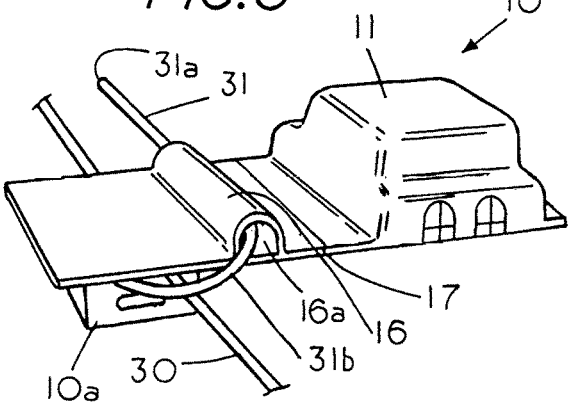
FIG. 6 is a perspective view of the tubular wire guide on the outside of the lid mounted insulation displacement connector.

FIG. 6 is a perspective view of the back side of the wire connector 10 showing the tubular wire guide 16 located on the outside of the lid 18 and extending across the lid 18. Note, the wire 31 loops back 180 degrees to form a slack loop 31*b* before the wire 31 enters the wire port 40 (see FIG. 5) in the lid mounted insulation displacement connector 10*a*.

Figure 7:
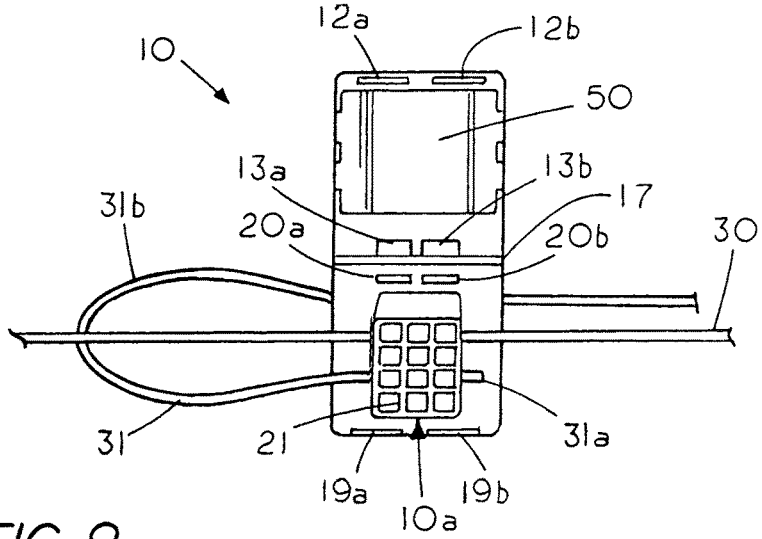
FIG. 7 is a top view of the tubular wire guide on the outside of the lid mounted insulation displacement connector.

FIG. 7 is a top view of the lid mounted insulation displacement connector 10*a* showing that the uncut wire 30 extends crosswise through the insulation displacement connector 10*a* and the cut branch wire also extends through insulation displacement connector 10*a*, however wire 31 forms a slack loop 31*b*, which provides slack to the wire to resist dislodging the connection between the branch wire and the main wire. That is, the slack loop 31*b* provides a buffer in the event an external force is applied to the cut wire 31. While the slack loop 31*b* absorbs wire displacement a further feature of the invention is that once the slack loop 31*b* in wire 31 is taken up the wire creates frictional resistance to further displacement through the corner engagement of the wire 31 with the edge of the lid 18 and the corner engagement of wire 31 with an edge of the tubular guide 16. This feature further reduces any pulling strain on the connection between the wire 31 and the blades 25 thus further enhancing the resistance of the wire connector to failure due to an electrical connection being disrupted during handling or burial of the wire connector.

In the example shown in FIG. 7 a waterproof sealant 50 is located in the chamber in housing 10*b* to enable the encapsulation of the insulation displacement wire connector 10*a* and the wires therein in order to protect the wire connections from the environment.

FIG. 8 is a perspective view of the wire connector 10 showing the latch hooks 20*a* and 20*b* in engagement with lip 13 and the latch hooks 19*a* and 19*b* in engagement with lip 12 to hold the lid 18 on the housing 10*b* thereby protecting the contents of the wire connector from a hostile environment while allowing the wires therein to protrude through a sidewall of the housing. A further feature is that the four corner engagement of hooks 19*a*, 19*b*, 20*a* and 20*b* ensures that the lid 18 and housing 11*a* remain attached during handling, while the living hinge provides for ease in lining up the latches and the latch hooks when the lid 18 is folded onto the housing 10*b*.

We claim:

1. A wire connector for attaching a branch wire to a continuous uncut wire without severing the uncut wire comprising:

an insulation displacement connector having a laterally enterable wire port for insertion of an uncut wire therein;

a further wire port for insertion of a branch wire therein; and a tubular wire guide external to a housing of the insulation displacement connector for looping the branch wire therethrough to form a slack loop thereon as the branch wire is extended into the further port in the insulation displacement connector.

2. The wire connector of claim 1 wherein the insulation displacement connector includes a piston carrying a set of wire displacement blades and a sleeve slidably supporting the piston therein for forming an electrical connection between the branch wire and the uncut wire.

3. The wire connector of claim 1 wherein the insulation displacement connector is mounted on a lid of a housing through a living hinge with a sidewall of the housing including a set of flexible wire flaps for laterally insertion of a wire into the sidewall of the housing.

4. The wire connector of claim 1 wherein the tubular wire guide is laterally offset from the insulation displacement connector and the opening in the wire guide is sufficiently larger in diameter of the branch wire so the branch wire can be pushed through the wire guide relying on the axial stiffness of the branch wire.

5. The wire connector of claim 4 wherein the piston has a flat top for engagement with a jaw of a plier and the exterior of the insulation displacement connector has a flat surface for engagement with a further jaw of the plier with the piston axially slideable within a piston sleeve in said wire connector.

6. The wire connector of claim 4 wherein an opening in the tubular wire guide extends in the same direction as an opening in the further wire port.

7. A wire connector for attaching a branch wire to a continuous uncut wire without severing the uncut wire comprising:

a housing containing a chamber;

a first lip on a one end of the housing with a hook latch in the first lip;

a first sidewall on said housing with a set of laterally enterable flexible wire entry ports on the first sidewall and at least one laterally enterable flexible wire entry port on an opposite sidewall of the housing;

a lid connected to said housing through a living hinge, said lid having an exterior surface with a tubular wire guide thereon and an interior surface with an insulation displacement wire connector secured thereto, said insulation displacement wire connector including a laterally open wire port for placement of the uncut wire therein and a further wire port for insertion of an end of the branch wire therein, said insulation displacement connector including a slideable mounted piston containing a set of electrically conductive wire displacement blades so that displacement of the slideable piston toward the lid brings the uncut wire in the laterally open wire port into electrical contact with the branch wire in the further wire port through the set of electrically conductive wire displacement blades therein so that the lid with the branch wire and the uncut wire in electrical contact with each other can be secured to the housing through engagement of a lid hook on the lid with the hook latch on the housing to form an enclosure around the insulation displacement connector.

8. The wire connector of claim 7 wherein the insulation displacement connector wire connector on the interior surface and the tubular wire guide are axially offset from each other so that as one brings the slideable mounted piston toward the lid by engaging one side of the piston with one jaw of a plier and the exterior surface of a lid with another jaw of the plier a slack loop in the branch wire minimizes disruption to an electrical connection in the wire connector.

9. The wire connector of claim 7 including a sealant located in said chamber for encapsulating said insulation displacement connector therein.

10. The wire connector of claim 7 including a lid hook on each end of said lid and a hook latch on each end of the housing for securement of said lid to said housing independent of the living hinge.

11. The wire connector of claim 7 wherein the branch wire extends through one of the flexible entry wire ports and the uncut wire extends through a flexible wire entry port on one side of the housing and a further flexible wire entry port on the opposite side of the housing when the lid is brought into engagement with said housing.

12. The wire connector of claim 7 wherein the branch wire extends through the tubular guide and loops backward into the further wire port to form a slack loop to prevent accidental withdrawal of the branch wire during an underground installation of the wire connector.

13. The wire connector of claim 7 wherein an opening in the tubular guide is larger than a diameter of the branch wire so that the branch wire can be axially inserted therethrough by cantileverly holding the branch wire in a user's hand.

14. The wire connector of claim 7 including at least two hook latches in each lip on said housing and at least two hooks on each end of the lid.

15. The wire connector of claim 7 wherein the tubular guide is laterally offset from the further wire port with a slack loop in the branch wire extending between the tubular guide and the further wire port.

16. The method of securing an uncut wire to a branch wire comprising the steps of:

inserting the uncut wire into a laterally open wire guide in an insulation displacement connector;

inserting an end of the branch wire through a tubular guide on the exterior of the insulation displacement wire before inserting the end of the branch wire into a wire port in the insulation displacement connector to form a slack loop in the branch wire between the tubular guide and the insulation displacement connector; and bringing a set of blades in the insulation displacement connector into engagement with both the uncut wire and the branch wire to form an electrical connection therebetween.

17. The method of claim 16 including the step of inserting the insulation displacement connector into a housing to form an enclosure around the insulation displacement connector with the branch wire and the uncut wire extending through a sidewall of the housing while maintaining the slack loop in the branch wire.

18. The method of claim 16 including the step of bringing the insulation displacement connector into a sealant located in said housing.

19. The method of claim 16 including the step of bringing the set of blades in the insulating displacement connector into engagement with the uncut wire and the branch wire by applying axial pressure to a piston on one end of the insulation displacement connector and to a lid supporting a piston sleeve by compressing the piston and the lid between the jaws of a plier to force the set of blades in the piston into electrical engagement with the branch wire and the uncut wire.

20. The method of claim 16 including the step of latching a lid supporting the insulation displacement connector into engagement with both ends of a housing containing a sealant.

21. The method of claim 16 including the step of encapsulating the insulation displacement connector into a housing by pivoting the insulation displacement connector about a living hinge connecting the insulation displacement connector to the housing and laterally forcing branch wire and the uncut wire into wire connector flaps in the housing while maintaining the slack loop in the branch wire.

* * * * *